United States Patent [19]

Aubert et al.

[11] Patent Number: 4,590,752

[45] Date of Patent: May 27, 1986

[54] METHOD AND DEVICE FOR THE MANUFACTURE OF FLEXIBLE TUBULAR BODIES

[75] Inventors: Jean P. Aubert, Puteaux; Roland Bracon, La Mailleraye sur Seine; Bernard Ravasy, Caudebec en Caux, all of France

[73] Assignee: Coflexip, Paris, France

[21] Appl. No.: 780,701

[22] Filed: Sep. 25, 1985

Related U.S. Application Data

[63] Continuation of Ser. No. 506,355, Jun. 21, 1985, abandoned.

[30] Foreign Application Priority Data

Jun. 22, 1982 [FR] France ..... 82 10880

[51] Int. Cl.[4] ..... B21F 3/04; B21F 7/00; B65H 81/08

[52] U.S. Cl. ..... 57/9; 29/820; 57/311; 140/71 C; 140/149

[58] Field of Search ..... 57/3, 6, 9, 311; 29/819, 820, 825, 828; 140/2, 71 R, 71 C, 118, 123, 124, 149

[56] References Cited

U.S. PATENT DOCUMENTS

| | | | |
|---|---|---|---|
| 1,808,444 | 6/1931 | Zapf | 57/9 |
| 1,809,032 | 6/1931 | Gregson | 57/9 |
| 1,998,430 | 4/1935 | Barclay | 57/9 |
| 3,090,190 | 5/1963 | Boussu et al. | 57/311 X |
| 3,396,522 | 8/1968 | Biagini | 57/311 X |
| 3,717,987 | 2/1973 | Gilmore et al. | 57/9 |
| 3,779,058 | 12/1973 | Norman | 140/149 X |
| 3,811,257 | 5/1974 | Burr | 57/311 X |
| 4,075,880 | 2/1978 | Copeland | 140/149 X |
| 4,195,469 | 4/1980 | Tarantola | 57/311 |

*Primary Examiner*—John Petrakes
*Attorney, Agent, or Firm*—Brisebois & Kruger

[57] ABSTRACT

The invention refers to a method and a device for the manufacture of flexible tubular bodies in which one or more profiled strands are deformed spirally in a permanent manner before proceeding to winding it or them spirally in order to form a cylindrical carcass, by making the profiled strand pass over two pulleys in succession.

The profiled strand is wound on the flat round each of the pulleys, the axes of the two pulleys being angularly offset so as to cause a permanent twist in the length of profiled strand situated between the said two pulleys.

19 Claims, 5 Drawing Figures

METHOD AND DEVICE FOR THE MANUFACTURE OF FLEXIBLE TUBULAR BODIES

This is a continuation of application Ser. No. 506,355, filed June 21, 1985, and now abandoned.

The invention refers to a method of manufacture of flexible tubular bodies comprising at least one carcass which is obtained by winding one or more profiled strands in a spiral or helix having adjacent turns, and which cooperates in general with one or more sheaths. Such flexible tubular bodies are employed, for example, as flexible pipework, in particular for the conveyance and collection of hydrocarbons proceeding from undersea deposits, or else for the flexodrilling of oilwells. The invention likewise refers to a device for putting this method into effect, as well as to the flexible bodies obtained.

Methods are already known for the manufacture of flexible tubular bodies in which because of the impossibility of deforming the profiled strand spirally or helically in a permanent manner at the time of winding, for example, because the winding is carried out by a rigid underlying carcass, a permanent spiral deformation is conferred upon it before winding it.

These known methods consist in causing the profiled strand to pass over successive pulleys so as to cause twisting of the profiled strand beyond its elastic limit.

Thus a method is already known in accordance with the U.S. Pat. No. 3,811,257 in which a wire of non-circular cross-section is pinched between two successive pairs of rollers suitably arranged in order to obtain a permanent spiral or helicoidal deformation by twisting of the profiled strand. Provision is moreover made in this document for ensuring continuous bending of the profiled strand between the downstream pair of rollers and the winding station. The method described is satisfactory to use for profiled strands of very much flattened cross-section.

It has proved, however, that when profiled strands are employed of which the cross-section, without becoming perfectly round, nevertheless approaches a circular cross-section, for example, in the case of profiled strands having an elliptical cross-section or else a rectangular cross-section which is nearly square, the forces to which the pulleys are subjected in order to prevent rotation of the profiled strand which is being subjected to twisting, become too great and the pulleys no longer have the power of keeping the profiled strand in the required position and let the profiled strand escape, which twists so that the deformation obtained becomes irregular or even nil.

The invention proposes to cure this disadvantage and to enable permanent spiral deformation of profiled strands or wires and especially of those having a cross-section which is very little flattened, one of the faces of which is intended to form the inner surface of the spiral carcass and the opposite face of which is intended to form the outer surface of it, and to do this simply and cheaply.

The object of the invention is a method of manufacture of flexible tubular bodies in which one or more profiled strands are deformed spirally in a permanent manner before proceeding to winding it or them spirally in order to form a cylindrical carcass, by making it pass over two pulleys or rollers in succession, characterized by the fact that the profiled strand is wound on the flat round at least one and preferably round each of the pulleys, the axes of the two pulleys being angularly offset.

In a preferred way of putting the invention into effect, the profiled strand is wound round at least one of the pulleys along at least approximately one turn, and preferably round the two pulleys along more than one complete turn.

Thanks to the invention the profiled strand is not simply pinched at the level of the pulleys but is wound on the flat, which enables wires of any cross-section to be deformed spirally, the forces necessary for preventing rotation of the profiled strand being subjected to twisting, being distinctly smaller than during pinching.

The invention may thus be put into effect with products known as "fragile", such as profiled strands not having a very much flattened shape and of small cross-section or profiled strands coated with plastics or metal, without damaging the coating. Moreover it is not necessary to provide apparatus for bending of the profiled strand downstream of the second roller before winding it to form the tubular body.

In accordance with an advantageous characteristic of the invention the twisting of the profiled strand may be adjusted by regulating either the angular offset between the two pulleys or the distance separating the two pulleys or by regulating both the offset and the distance.

The object of the invention is likewise a device for putting this method into effect, characterized by the fact that it comprises two pulleys which are motor-driven or not, spaced from one another by a certain distance and angularly offset in space, means being preferably provided for regulating the said angular offset and/or the distance between the pulleys.

In accordance with a first embodiment in accordance with which the axes of the pulleys are substantially arranged in two planes perpendicular to the length of profiled strand which extends between the pulleys, at least one of the pulleys is mounted in a pulley support capable of pivoting about the axis represented by the said length of profiled strand, means being in addition provided for regulating the distance separating the said pulleys.

In a second embodiment in which the axes of the pulleys which are preferably formed as flanged pulleys, are not fixed in planes perpendicular to the length of profiled strand extending between the pulleys, at least one of the pulleys may advantageously be mounted in a support which can be moved about the plane of the pulley itself.

In this second embodiment means of deflection are preferably provided on the pulleys in order to force the length of profiled strand to wrap itself round the pulley in a plane which is substantially perpendicular to the axis of the pulley, where these means of deflection may advantageously consist of sidecheeks exhibited by the pulleys which may then take the form of flanged pulleys.

The object of the invention is likewise the flexible tubular bodies obtained by the method in accordance with the invention, the said bodies being characterized especially by the fact that they comprise at least one carcass formed by the winding of a profiled strand in a spiral having adjacent turns, especially of a profiled strand having a cross-section which is not very much flattened, but which has previously been deformed spirally in a permanent manner by winding on the flat round pulleys which are angularly offset, the profiled strand in the carcass extending in a uniform fashion to present always one and the same face to the inside of the carcass.

Other advantages and characteristics of the invention will become apparent from reading the following description made by way of non-restrictive example and referring to the attached drawing in which.

Figure 1:
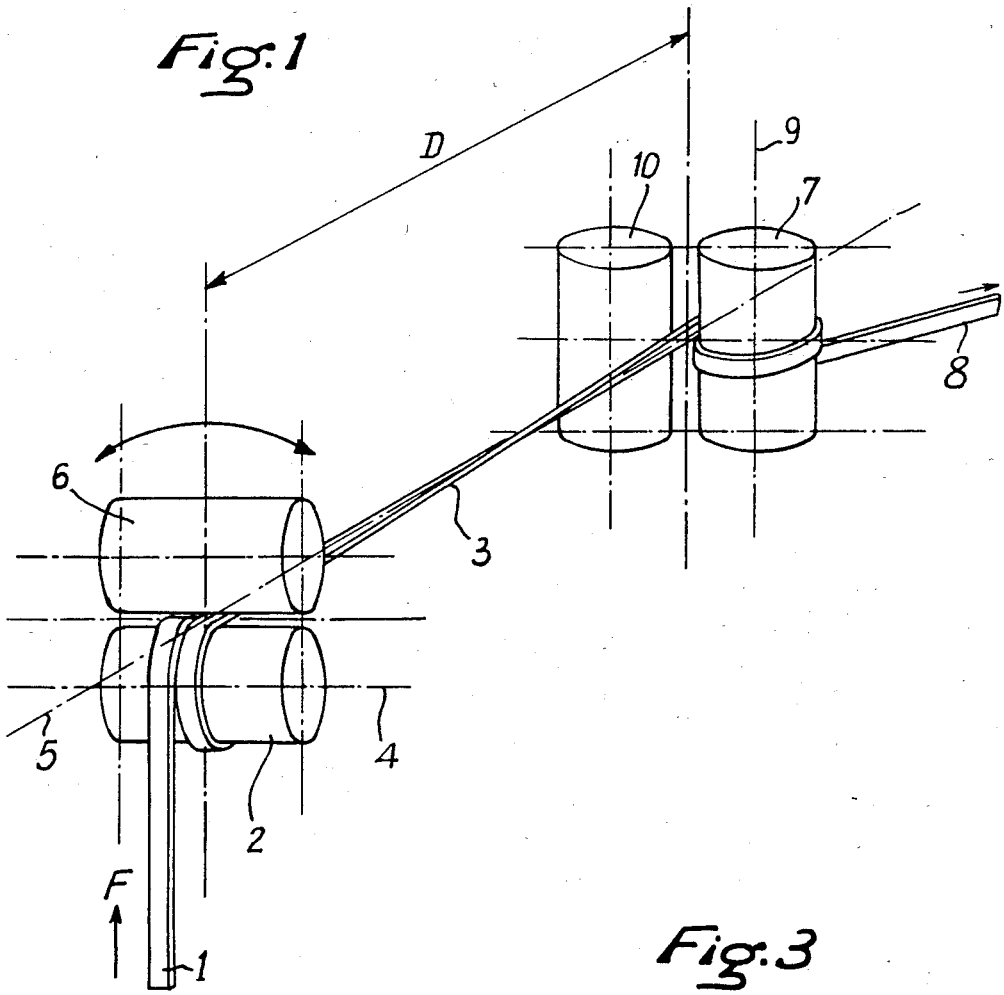
FIG. 1 represents a diagrammatic view of a first embodiment of the invention.

Referring to FIG. 1, a profiled strand 1 is seen, which appears to the form of a profiled strand of steel of a rectangular cross-section which is not very much flattened, the strand passing in the direction of the arrow F whilst coming from a reel of profiled strand, which is not shown.

The profiled strand 1 is wound, making a complete turn on the flat, round a first pulley or roller 2 which it leaves along a length 3 having a substantially straight trajectory. The geometrical axis 4 of the pulley 2 extends in a plane perpendicular to the direction of the length 3, the geometrical axis of which has been shown at 5. A counterpulley 6 may possibly be arranged, but this counterpulley does not play the main part in keeping the profiled strand properly on the flat round the pulley 2.

The diameter of the pulley 2 is such that the wrapping of the profiled strand 1 round the diameter is carried out by simple non-permanent elastic deformation.

The length 3 of profiled strand arrives next at a second pulley or roller 7, the dimensions of which are identical with or similar to those of the pulley 2 and round which it is wound on the flat along a complete turn before leaving the pulley 7 at 8. The geometrical axis 9 of the second pulley 7 is likewise situated in a plane perpendicular to the axis 5 of the length 3 of profiled strand. A counterpulley 10 may possibly be present, playing a similar part to that of the counter-pulley 6.

D represents the distance between the parallel planes in which are contained the axes 4 and 9, this distance D being practically equal to the length 3 of profiled strand.

In the position represented in the drawing, the axes 4 and 9 are aligned along perpendicular directions. It will be understood that under these conditions the profiled strand 1 along its length 3 becomes deformed out of its plane in a twist. If the distance D is sufficiently short this twist exceeds the limit of elastic twisting of the profiled strand and becomes permanent. This twisting may be increased if the axis 4 is made to pivot in its plane about the geometrical axis 5 in a clockwise direction whereas it may be reduced if the axis 4 is made to pivot in the anticlockwise direction until becoming zero when the two axes 4 and 9 become parallel with one another.

It is thus possible to regulate the degree of twist by acting both upon the distance D which separates the pulleys 2 and 7 as well as upon the respective angular inclination between the axes 4 and 9 of these pulleys. Of course the distance D may be considerably increased whilst allowing permanent deformation, if the angular offset between the axis 4 and the axis 9 increases, where this angular offset may of course reach a number of complete turns, in which case the length 3 of profiled strand would be twisted a number of times about itself. In other words the angular offset in the sense of the present invention corresponds with the angle of twist of the profiled strand.

Hence the length 8 of profiled strand which leaves the pulley 7 exhibits a permanent twist which corresponds with a spiral deformation the pitch of which, determined by the geometry of the assembly of pulleys 2, 7 is adapted to the spiral winding which it is desired to obtain in order to form the tubular body.

By way of example, for a profiled strand having a rectangular cross-section the dimensions of which are 6 mm×3 mm, a winding of the profiled strand in a spiral having adjacent turns may be obtained with an angular offset of 90° between the axes 4 and 9, with tensile forces of the order of 45 kg. This force is to be compared with the former-heads known at present, on which it is of the order to 160 kg.

Figure 2:
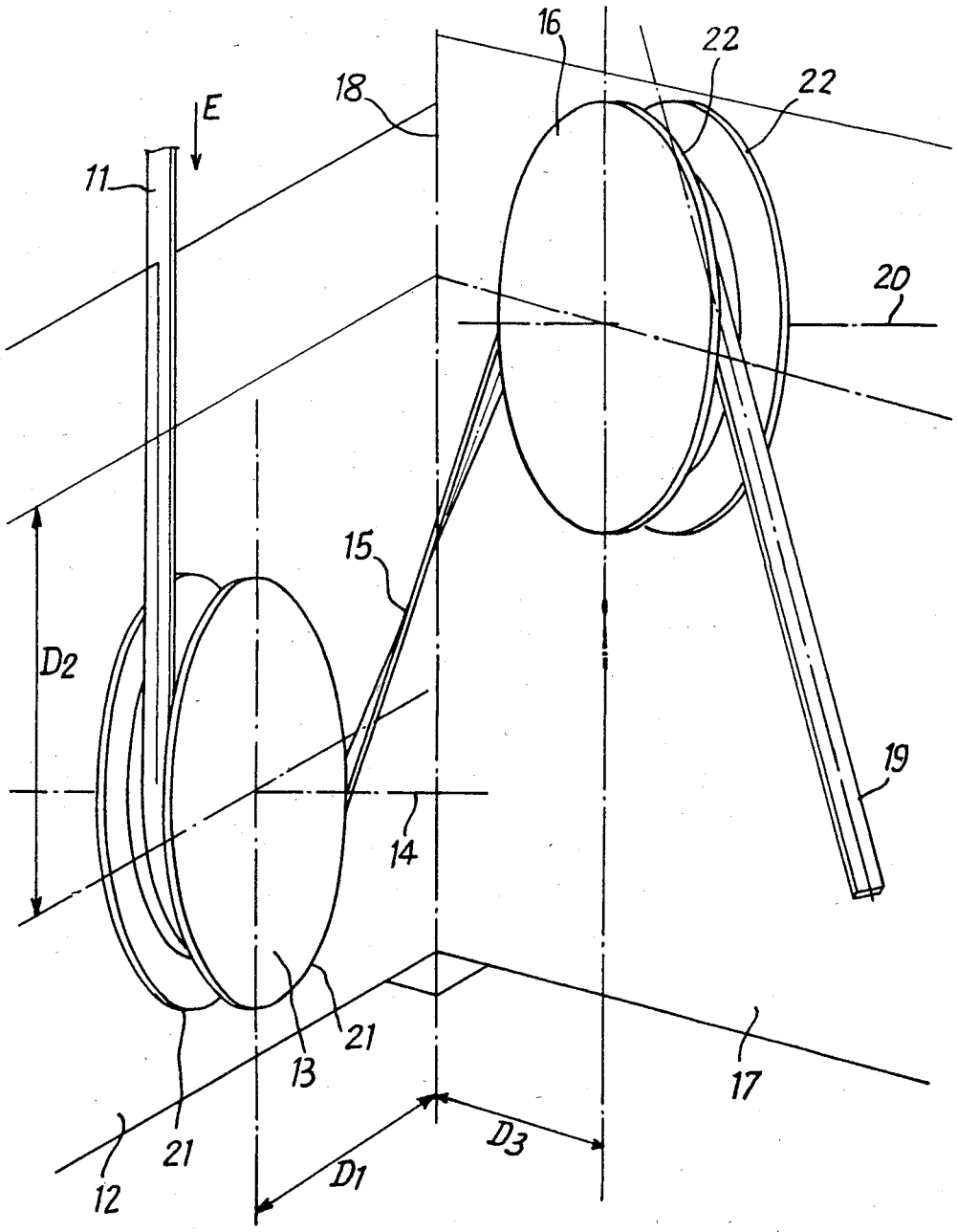
FIG. 2 represents a diagrammatic view of a second embodiment of the invention.

Refer now to FIG. 2.

In this embodiment a profiled strand 11 having a rectangular cross-section is passing in the direction of the arrow E in the verticl plane 12 through a first pulley 13 the axis 14 of which is perpendicular to the plane 12, the profiled strand 11 making a complete turn on the flat round the pulley 13.

The length 15 which leaves the pulley 13 is wound round a second pulley 16 situated likewise in a vertical plane 17 which cuts the vertical plane 12 along a vertical line of intersection 18, the profiled strand after having made one complete turn on the flat round the pulley 16, leaving along a trajectory 19 lying in the plane 17. The axis 20 of the pulley 16 is perpendicular to the plane 17. It may be seen that in this embodiment the axes 14 and 20 of the pulleys are not lying in planes perpendicular to the length 15 of profiled strand, which departs both from the plane 12 and from the plane 17. Because of this direction of the length 15, provision has been made to equip the pulleys 13 and 16, respectively, with cheeks or flanges 21, 22, so that the pulleys take the form of flanged pulleys.

In order to regulate the degree of twist of the length 15 of profiled strand one may advantageously regulate firstly the distance D1 which separates the axis 14 from the line of intersection 18 as well as the distance D2 which separates the horizontal planes of the axes 14 and 20. One may likewise regulate the distance D3 which separates the axis 20 from the line of intersection 18.

Figure 3:
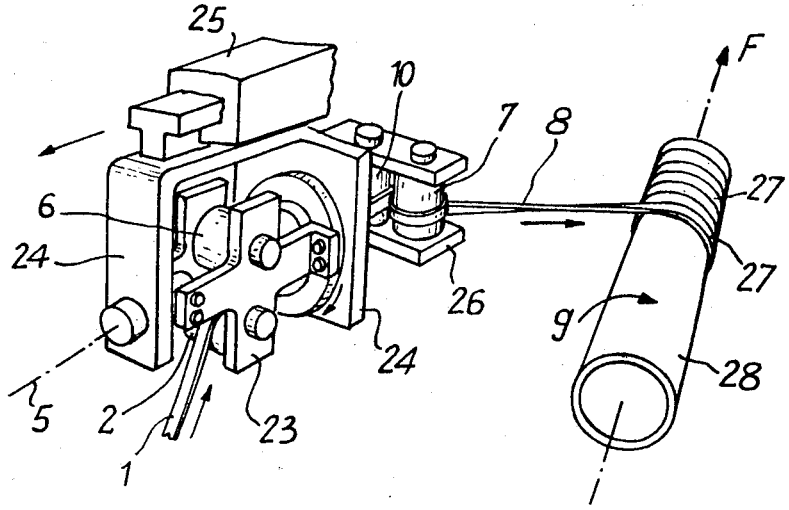
FIG. 3 shows a first preferred apparatus of the embodiment of FIG. 1.

Refer now to FIG. 3.

In this particular embodiment which corresponds with the embodiment as FIG. 1, the pulleys 2 and 6 are mounted on an apparatus 23 which in turn is mounted pivotally about the axis 5 in a carriage 24 capable of sliding in parallel with the axis 5 in a fixed slide 25.

By making the carriage 24 slide along the slide 5, the length 3 of profiled strand may be increased or reduced.

The pulleys 7 and 10 are mounted on a frame 26 which itself is immovable with respect to the slide 25. From the pulley 7 the length 8 of profiled strand goes across to be wound to form the adjacent turns 27 of a metal carcass wound round an inner tube 28.

This formation of the carcass 27 is known in itself and hence no means have been shown to enble this carcass to be formed. It will be sufficient to state clearly that the tubular body which is thus formed moves away in the direction of the arrow F whilst turning about its own axis as shown by the arrow g.

It will be understood that the device shown enables permanent spiral deformation of the profiled strand 1 to be ensured, whatever the dimensions of the tube 28 as well as the desired pitch for the turns 27. That is, it will be sufficient in order to modify these characteristics, to move the carriage 24 further away from or nearer to the frame 26 and to modify the angular position of the apparatus 23 about the axis 5 with respect to the carriage 24, locking means being provided for keeping the apparatus in its required pivoted positions.

Figure 4:
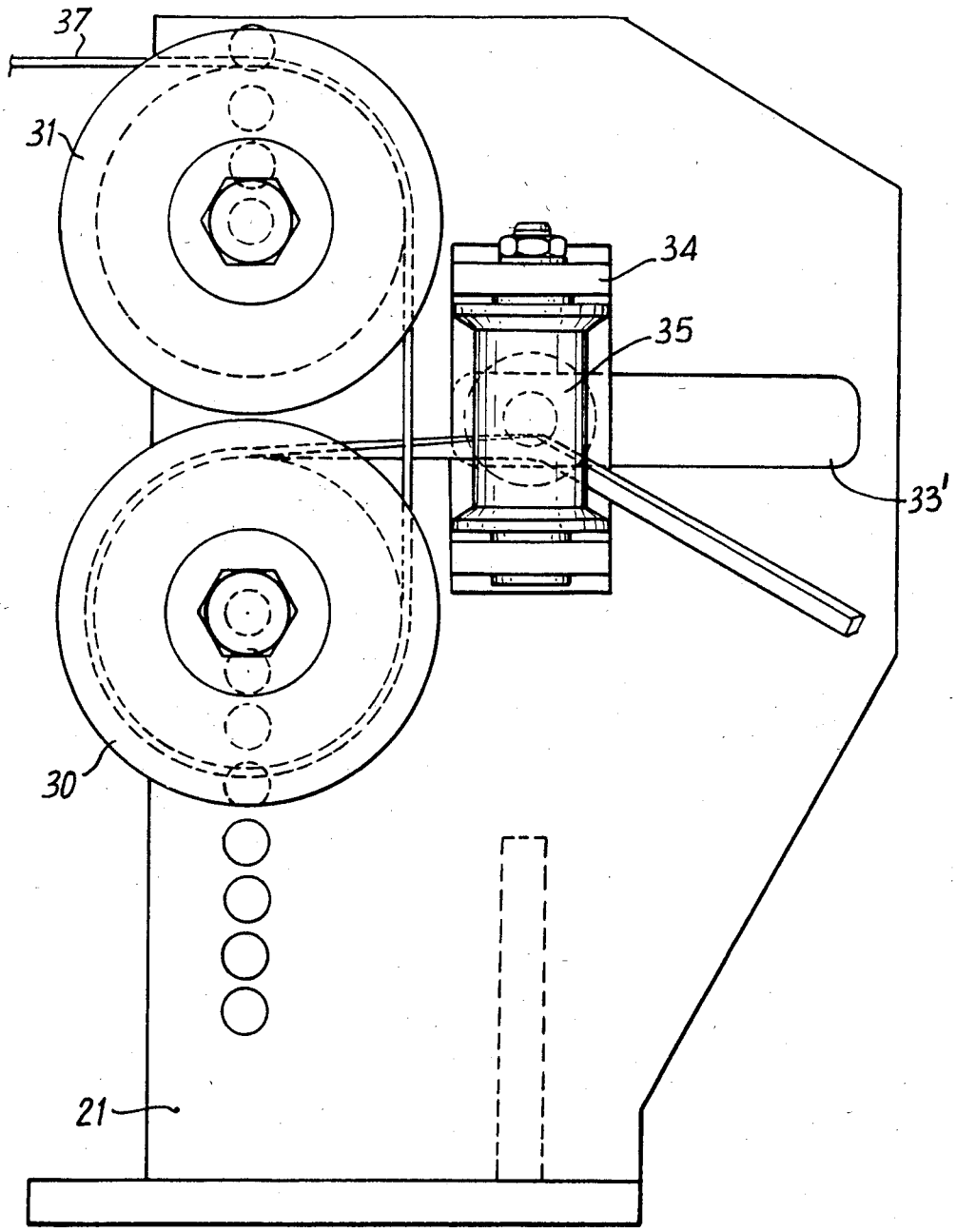
FIG. 4 is a front view of a second preferred apparatus of the embodiment of FIG. 1.
Figure 5:
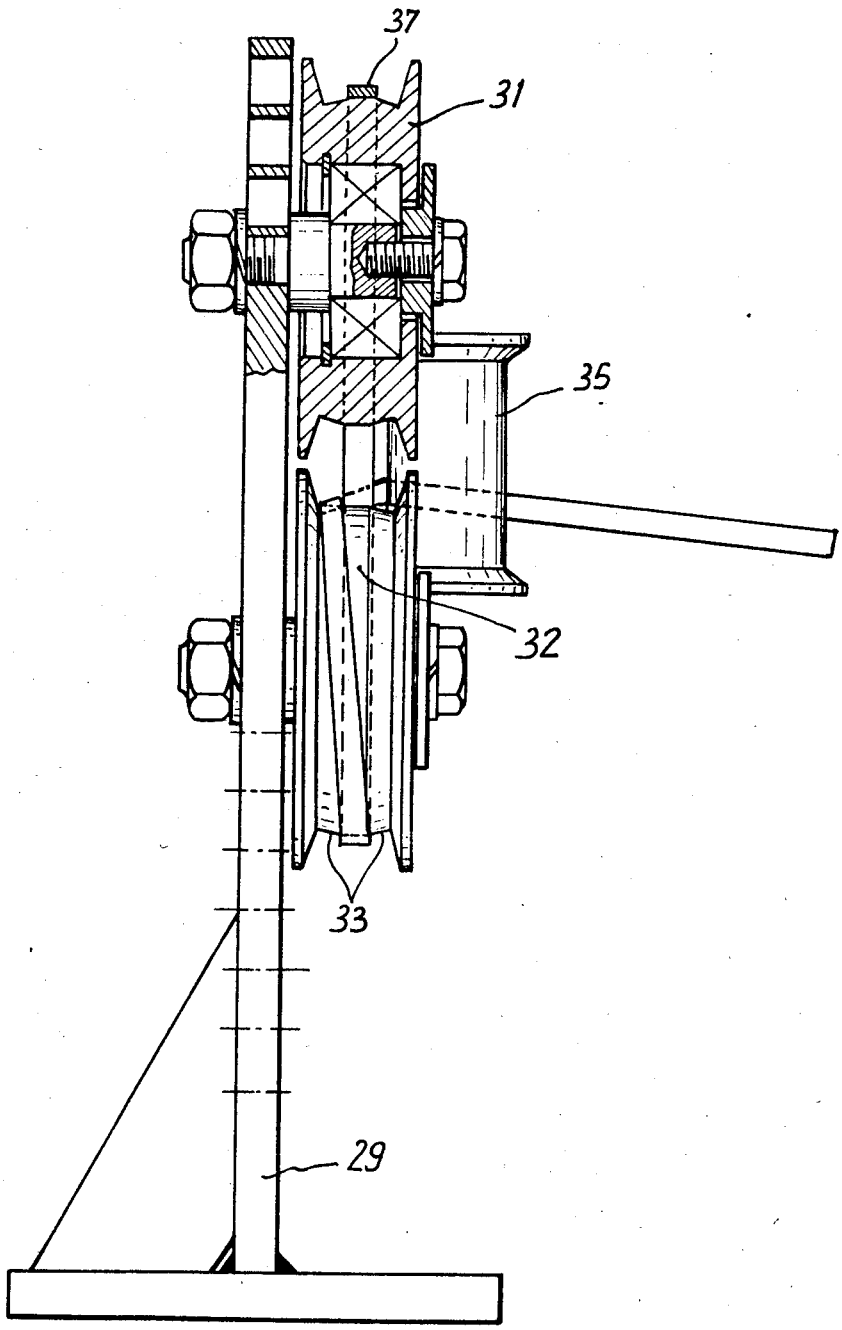
FIG. 5 is a side view of the apparatus of FIG. 4.

Refer now to FIGS. 4 and 5.

The device comprises, pivoted on a frame 29, two flanged pulleys 30, 31. It may be seen in FIG. 5 that the neck of each pulley comprises three portions, namely, a substantially cylindrical central portion 32 and two frustoconical side portions 33 which become smaller in diameter towards the edges of the pulley.

The frame 29 exhibits a horizontal slot 33' which enables the locking at a desired distance from the pulleys 30 and 31 and at a desired tilt in the plane of the frame 29, of a small stirrup 34 which supports a cylindrical pulley having a wide neck 35, the diameter of which is distinctly less than the diameter of the pulleys 30, 31.

After having regulated the position of the pulley 35 thanks to means such as a nut, a sheathed wire 37 is brought to it, which has been delivered on the flat by the pulley 30. After having made three-quarters of a turn round the pulley 30, the wire leaves this pulley in order to be directed towards the pulley 35 and becomes twisted in a permanent manner along the trajectory between the said two pulleys 30 and 35.

As a variant it would be equally possible to make the wire come directly round the pulley 30 and to wrap it by at least one complete turn on the flat and to direct it round the pulley 35 round which it may possibly make one complete turn on the flat.

Although the invention has been described with respect to particular embodiments it is of course in no way restricted to them and sundry modifications of shapes or materials may be applied to it without thereby departing from either its scope or its spirit.

We claim:

1. A method of making a flexible tubular body in which at least one profiled strand is permanently deformed heliocidally before winding the strand helically to form a cylindrical carcass, said method comprising passing the profiled strand flat against and at least partially around a face of a first roller rotatable about a first axis, and then passing the profiled strand flat against and at least partially around a face of a second roller spaced from the first roller, and rotatable about a second axis which is angularly offset with respect to the first axis, wherein the profiled strand is wound at least one turn around at least one of the rollers, said faces of said rollers each having a profile corresponding to the profile of a surface of the strand which engages the roller faces, so that the strand is twisted axially in the space between the two rollers and acquires a permanent helicoidal deformation.

2. A method according to claim 1, wherein the profiled strand is wound at least one turn around each of the rollers.

3. A method according to claim 2, wherein the profiled strand is wound more than one complete turn around each of the rollers.

4. A method according to claim 1, wherein the profiled strand is held against the respective faces of said rollers by counter-rollers.

5. A method according to claim 1, wherein the rollers are each pulleys having side flanges, and the faces are between side flanges of the pulleys.

6. A method according to claim 1, wherein the strand has a flat surface and the face of each roller is cylindrical.

7. A method according to claim 1, wherein the strand has a flat surface, the face of at least one roller is cylindrical, and the face of the other roller is frusto-conical.

8. Apparatus for making a flexible tubular body composed of a helically wound strand of non-circular section comprising, a first roller having a circumferential surface of a profile corresponding to the profile of a surface of the strand, said first roller being rotatable about a first axis, a second roller spaced from the first roller and having a circumferential surface of a profile corresponding to the profile of a surface of the strand, said second roller being rotatable about a second axis angularly offset from said first axis, said strand being fed to and extending at least one full turn around said first roller, a length of the strand extending between the first roller and the second roller, and said strand extending at least one full turn around said second roller, said first and second rollers and said circumferential surfaces comprising means for axially twisting said length of the strand between said rollers to permanently deform the strand helicoidally, and means downstream of said second roller for winding the deformed strand into a flexible tubular body.

9. Apparatus according to claim 8, further comprising adjustable means for adjusting the extent of axially twisting of said length of strand between said rollers.

10. Apparatus according to claim 9, wherein said adjustable means comprises means for adjusting the extent of angular offset of said axes.

11. Apparatus according to claim 9, wherein said adjustable means comprises means for adjusting the distance between the rollers.

12. Apparatus according to claim 8, wherein said first and second axis lie respectively in spaced apart parallel planes perpendicular to said length of the strand extending between said rollers.

13. Apparatus according to claim 12, wherein one of said rollers is adjustably along the axis of the length of the strand extending between the rollers.

14. Apparatus according to claim 8, wherein the axis of at least one of the rollers is in a plane which is not perpendicular to the axis of the length of the strand extending between the rollers.

15. Apparatus according to claim 14, wherein at least one of said rollers comprises a pulley having flanges for deflecting the strand.

16. Apparatus according to claim 15, further comprising means for adjusting the position of said pulley in a plane perpendicular to its axis.

17. Apparatus according to claim 15, wherein said flanged pulley further comprises, a cylindrical center portion and frustoconical portions, at opposite sides of the cylindrical portion, said frustoconical portions decreasing in diameter away from the center portion.

18. Apparatus according to claim 8, wherein said adjustable means comprises, means for adjusting the extent of angular offset of said axes, and means for adjusting the distance between said rollers.

19. A method according to claim 1 wherein said profiled strand is a strand of non-circular profile.

* * * * *